US006116215A

United States Patent [19]

Soleanicov et al.

[11] Patent Number: 6,116,215

[45] Date of Patent: Sep. 12, 2000

[54] INTEGRATED THROTTLE VALVE AND ACTUATOR

[75] Inventors: Pavel A. Soleanicov, South Beloit; Elwood J. Meyers, Rockford, both of Ill.; Vladimir Pecheny, Berkeley, Calif.

[73] Assignee: The Barber-Colman Company, Loves Park, Ill.

[21] Appl. No.: 09/116,891

[22] Filed: Jul. 16, 1998

[51] Int. Cl.[7] ..... F02D 9/08

[52] U.S. Cl. ..... 123/399; 123/337

[58] Field of Search ..... 123/399, 361, 123/337, 403; 73/118.1; 251/305, 313, 129.11; 335/272

[56] References Cited

U.S. PATENT DOCUMENTS

| | | | |
|---|---|---|---|
| 4,392,375 | 7/1983 | Eguchi et al. | 73/118 |
| 4,438,745 | 3/1984 | Watannabe | 123/339 |
| 4,779,592 | 10/1988 | Takeuchi et al. | 123/399 |
| 5,121,727 | 6/1992 | Kramer et al. | 123/399 |
| 5,398,724 | 3/1995 | Vars et al. | 137/625.33 |
| 5,490,379 | 2/1996 | Wernberg et al. | 60/39.281 |
| 5,555,720 | 9/1996 | Wernberg et al. | 60/39.03 |
| 5,617,825 | 4/1997 | Altmann et al. | 123/337 |
| 5,619,112 | 4/1997 | Younessi et al. | 318/689 |
| 5,738,072 | 4/1998 | Bolte et al. | 123/399 |
| 5,752,484 | 5/1998 | Apel et al. | 123/396 |

*Primary Examiner*—Henry C. Yuen
*Attorney, Agent, or Firm*—Andrus, Sceales, Starke & Sawall

[57] ABSTRACT

A throttle valve includes a one-piece valve body defining a transverse flow passage and an actuation device cavity. The throttle valve includes a valve assembly having a shaft which extends through the flow passage and which is mounted to the valve body via a pair of aligned passages formed in the walls of the valve body defining the flow passage. One of the aligned passages establishes communication with the actuation device so as to enable the valve shaft to be assembled to the valve body through the actuation device cavity. A pole carrier is mounted to the valve shaft and a pair of pole members are secured to the pole carrier. An electromagnetic actuation device is mounted within the actuation device cavity and is operable on the pole members in a contactless manner to impart rotation to the valve shaft through the pole members and the pole carrier upon energization of a coil assembly associated with theelectromagnetic actuation device. A portion of the valve shaft extends from the valve body opposite the actuation device cavity, and a stop arrangement and sensor arrangement are interconnected with the valve shaft. The stop arrangement preferably includes stop structure formed integrally with the valve body and a stop member secured to the valve shaft. The sensor arrangement is a contactless assembly which includes a Hall-effect sensor assembly having a stationary portion mounted to the valve body and a rotatable portion engaged with the valve shaft so as to detect the position of the valve assembly relative to the valve body. Inputs from the sensor arrangement are provided to a controller, which is operable to control the position of the valve member by controlling the energization of the electromagentic actuation device, to thereby control the position of the valve member. The invention contemplates a number of improvements in the overall construction of the valve assembly and its components, as well as in the method by which the throttle valve is assembled. The valve shaft assembly is driven, and its position is sensed, in a contactless manner so as to reduce friction and provide increased life.

45 Claims, 6 Drawing Sheets

INTEGRATED THROTTLE VALVE AND ACTUATOR

BACKGROUND AND SUMMARY OF THE INVENTION

This invention relates to valves, and more particularly to a throttle valve for supplying combustion air or fuel-air mixture to an intake associated with an engine.

It is known to control the supply of fuel-air mixture to an engine intake by positioning a throttle valve between the engine and a mixer. The throttle valve defines a flow passage positioned between the mixer outlet and the engine intake inlet, and a valve member in the form of a butterfly or spool member is disposed within the flow passage. The position of the valve member controls the flow of fuel-air mixture supply through the flow passage to the engine intake. The valve member is coupled to the output shaft of an electromagnetic variable reluctance actuation device which functions to control the position of the valve member within the valve passage in response to input signals supplied to the electromagnetic actuation device. In the case of a fuel injected engine, the throttle valve controls the supply of combustion air to the engine intake.

A prior art throttle valve construction involves separate housings for the valve arrangement and the electromagnetic actuation device. In this construction, a valve subassembly is first constructed by rotatably mounting the butterfly or spool member within the flow passage defined by the valve housing, resulting in a valve subassembly. An electromagnetic actuation device such as a force motor assembly, which includes a sensor arrangement, is then mounted to a motor housing, resulting in a motor subassembly. The valve subassembly and the motor subassembly are then assembled together, which results in coupling the force motor output shaft with the butterfly or spool member, to provide a motor-driven valve assembly.

While the above-described valve construction and assembly is generally satisfactory, it involves creation of two separate subassemblies which are then are assembled together. Each subassembly contemplates a number of components and assembly steps, and an overall assembly step is required to provide the final valve assembly. This requires an alignment between the subassemblies and a coupling arrangement which complicates assembly of the valve.

It is the object of the present invention to reduce the overall parts requirement and number of assembly steps for producing a throttle valve assembly. It is a further object of the invention to provide a throttle valve assembly which is relatively simple in its components and assembly, yet which provides highly satisfactory operation and accurate positioning of the valve member within the flow passage. Yet another objection of the invention is to provide a throttle valve assembly in which the force motor and the sensor assembly are mounted to the valve body separately from each other. A still further object of the invention is to eliminate the requirement in the prior art to assemble the motor output shaft to a shaft carrying the butterfly or spool member.

In accordance with one aspect of the invention, a throttle valve assembly for supplying air or fuel-air mixture to an intake associated with an engine includes an integrally formed valve body adapted for mounting to the engine. The valve body defines an actuation device cavity, a flow passage adapted to communicate with the engine intake, and an opening extending between the flow passage and the actuation device cavity. The throttle valve assembly further includes a valve shaft including a first portion disposed within the flow passage and a second portion disposed within the actuation device cavity, and the valve shaft extends through the opening defined by the valve body. A valve member is mounted to the first portion of the valve shaft and is disposed within the flow passage for controlling the flow of air or fuel-air mixture therethrough. An electromagnetic actuation device is received within the actuation device cavity, and a contactless coupling arrangement is interposed between the second portion of the valve shaft and the electromagnetic actuation device for controlling the position of the valve shaft, and thereby the valve member, in response to operation of the electromagnetic actuation device.

In accordance with another aspect of the invention, a throttle valve assembly includes an integral valve body including a flow passage, an actuation device cavity, a sensor mounting structure, a first opening communicating between the flow passage and the actuation device cavity, and a second opening communicating between the flow passage and the location adjacent the sensor mounting structure. An electromagnetic actuation device is mounted within the actuation device cavity, and a shaft member extends transversely through the flow passage. The shaft member defines a first portion extending through the first opening and the second portion extending through the second opening, and the shaft member is rotatably supported relative to the valve body within the first and second openings. A valve member is mounted to the shaft member and disposed within the flow passage. A contactless coupling arrangement is interconnected with the first end of the shaft member for imparting rotation to the shaft member in response to operation of the electromagnetic actuation device. A position indicating member is interconnected with the second portion of the shaft member. A positioning sensing arrangement is mounted to the sensor mounting structure defined by the valve body for sensing the position of the shaft, and thereby the valve member, in response to orientation of the position indicating member relative to the position sensing arrangement. The valve body preferably defines opposed first and second ends, and the flow passage is formed so as to extend transversely through the valve body between the first and second ends. The actuation device cavity opens onto the first end of the valve body, and the sensor mounting structure is formed on the second end of the valve body.

In accordance with another aspect of the invention, an electromagnetic actuation device for imparting rotation to a valve shaft in a throttle valve assembly includes a coil housing having a solid central core and an annular coil recess surrounding the core and opening onto an end defined by the coil housing. The coil housing further defines an outer wall located outwardly of the coil recess. A coil is received within the coil recess, and a pole carrier is interconnected with the valve shaft. A pole arrangement is mounted to the pole carrier, and is oriented relative to the coil housing such that the coil arrangement extends into the coil recess inwardly of the end defined by the coil housing.

In accordance with yet another aspect of the invention, a drive arrangement for a throttle valve assembly includes an actuation device cavity formed in the valve body and a coil-type electromagnetic actuation device received within the actuation device cavity and interconnected with the valve body. The electromagnetic actuation device includes a coil housing defining an annular coil recess. A recess is formed in the valve body and extends from an inner end defined by the actuator device cavity. An output member, preferably in the form of an output shaft, is interconnected with the valve arrangement and rotatably mounted to the valve body. A pole carrier is disposed within the recess formed in the valve body, and is interconnected with the output member. A pole arrangement is interconnected with the pole carrier and extends into the coil recess for selectively imparting rotation to the pole carrier, and thereby to the output member, in response to energization of the coil. The output member is preferably in the form of a valve shaft to which the valve arrangement is mounted, and the pole carrier is preferably carried by the valve shaft. With this construction, the pole arrangement is carried by the valve shaft itself, which eliminates the need for coupling the valve shaft to the motor output shaft as in the prior art.

In accordance with yet another aspect of the invention, a stop arrangement for a throttle valve assembly includes stop structure defined by the valve body. The stop structure includes at least one shoulder, and a stop member is interconnected with the valve arrangement and oriented relative to the valve body so as to engage the shoulder when the valve arrangement attains a predetermined position relative to the valve body and the flow passage. Engagement of the stop member with the shoulder functions to prevent movement of the valve arrangement relative to the valve body when the valve arrangement attains a predetermined position relative to the valve body. In a preferred form, the stop structure includes a pair of spaced shoulders, and the stop member engages the shoulders to define the range of movement of the valve arrangement relative to the valve body.

In accordance with yet another aspect of the invention, a position sensing arrangement for a throttle valve assembly includes an extension member interconnected with the valve arrangement and a position indicating member carried by the extension member. A position sensing arrangement is secured to the valve body, and is operable to sense the position of the valve arrangement in response to orientation of the position indicating member relative to the position sensing arrangement. In this manner, the position sensing arrangement is operable to sense the position of the valve arrangement relative to the valve body. In a preferred form, stop structure is preferably formed on the valve body adjacent the location at which the position sensing arrangement is mounted to the valve body, so as to simplify assembly of the stop arrangement and the position sensing arrangement to the valve body and to remove the stop arrangement and the position sensing arrangement from the location at which the electromagnetic actuation device is mounted to the valve body.

In accordance with yet another aspect of the invention, a valve arrangement for a throttle valve assembly defines a flow passage and includes a valve shaft adapted for rotatable mounting to the valve body and a drive arrangement interconnected with the valve shaft for selectively imparting rotation to the valve shaft. A valve member is adapted for placement within the flow passage. The valve member is preferably in the form of a pair of wings extending laterally from an axially extending offset central mounting portion adapted to be secured to the valve shaft. This construction provides a simplified arrangement for forming a butterfly valve assembly and for mounting the butterfly valve assembly to the valve body.

In accordance with a still further aspect of the invention, a method of making a throttle valve includes providing a one-piece integrally formed valve body which defines a transverse flow passage in combination with an actuation device cavity. A first opening is formed in the valve body and extends between the motor cavity and the flow passage. A second opening is provided on the valve body on an opposite side of the flow passage from the first opening. The method contemplates inserting a valve shaft into the flow passage such that a first portion of the valve shaft is rotatably received within the first opening, and a second portion of the valve shaft is rotatably received within the second opening. A valve member is secured to the valve shaft within the flow passage, and an electromagnetic actuation device is then mounted within the actuation device cavity. The first portion of the valve shaft is drivingly coupled with the electromagnetic actuation device, preferably in a contactless manner, such that operation of the electromagnetic actuation device functions to control the position of the valve member within the flow passage.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
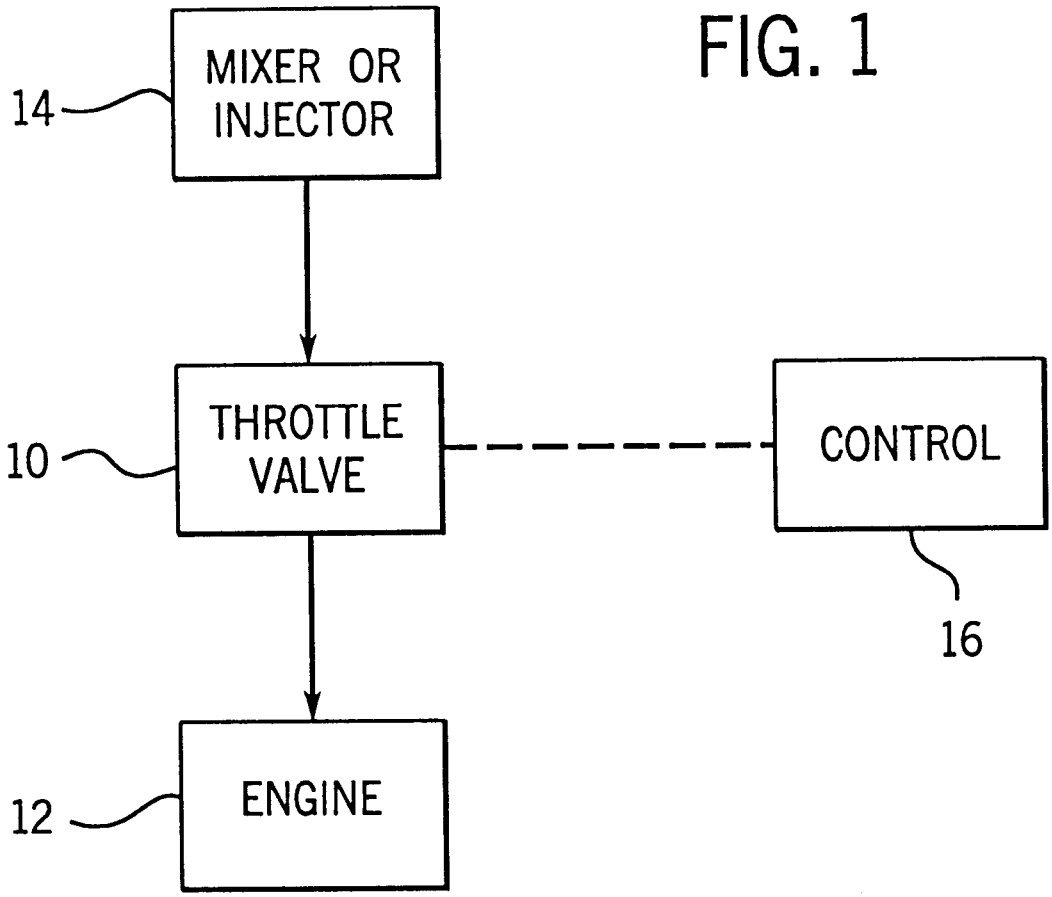
FIG. 1 is a schematic representation of the position of a throttle valve constructed according to the invention relative to an engine and a mixer, for controlling the supply of air or fuel-air mixture to the engine.
Figure 2:
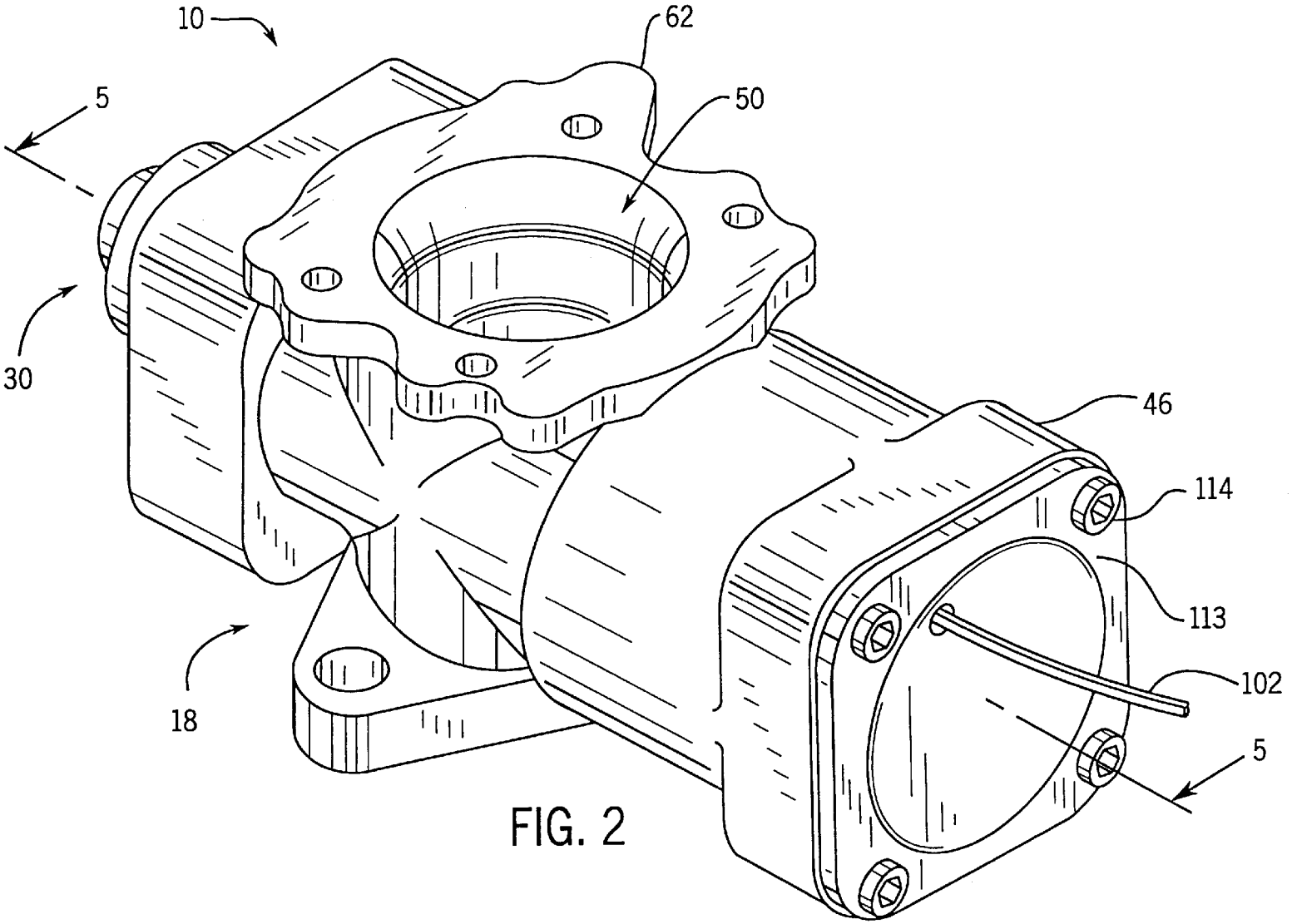
FIG. 2 is an isometric view of the throttle valve constructed according to the invention and adapted for placement as illustrated in FIG. 1.

FIG. 2 illustrates a throttle valve 10 constructed according to the invention which, as shown in FIG. 1, is adapted for mounting to an engine 12 for regulating the supply of air or fuel-air mixture to engine 12 as supplied by a mixer or fuel injector 14. A controller 16 is interconnected with throttle valve 10, in a manner to be explained, for regulating throttle valve and controlling the supply of fuel-air mixture therethrough to engine 12.

Figure 3:
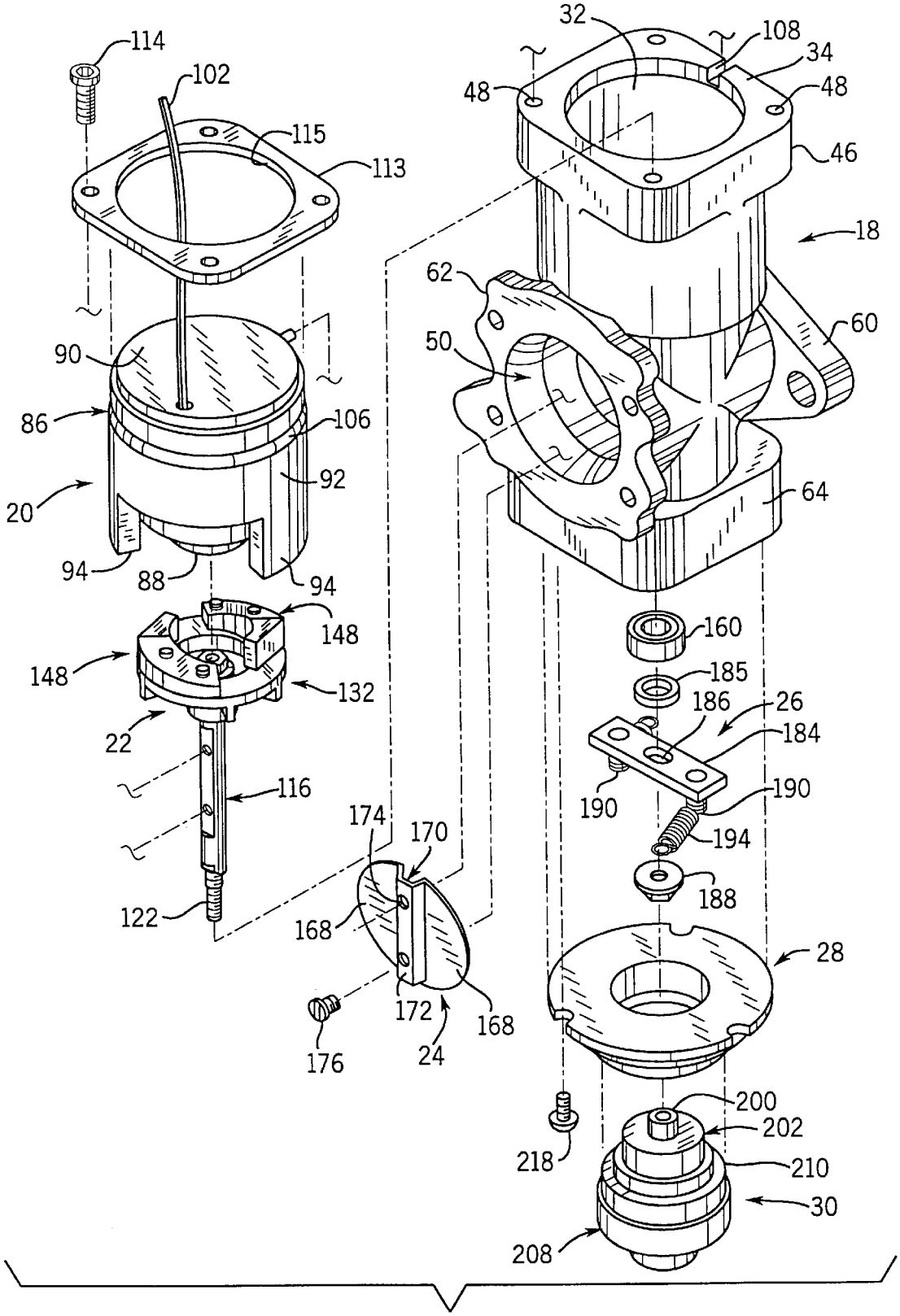
FIG. 3 is an exploded isometric view of the components of the throttle valve assembly of FIG. 2.

Referring to FIGS. 2 and 3, throttle valve 10 generally includes a valve body 18, a variable reluctance electromagnetic actuation device 20, a valve shaft assembly 22, a valve member 24, a stop arrangement 26, a sensor mounting flange 28 and a sensor assembly 30.

Figure 5:
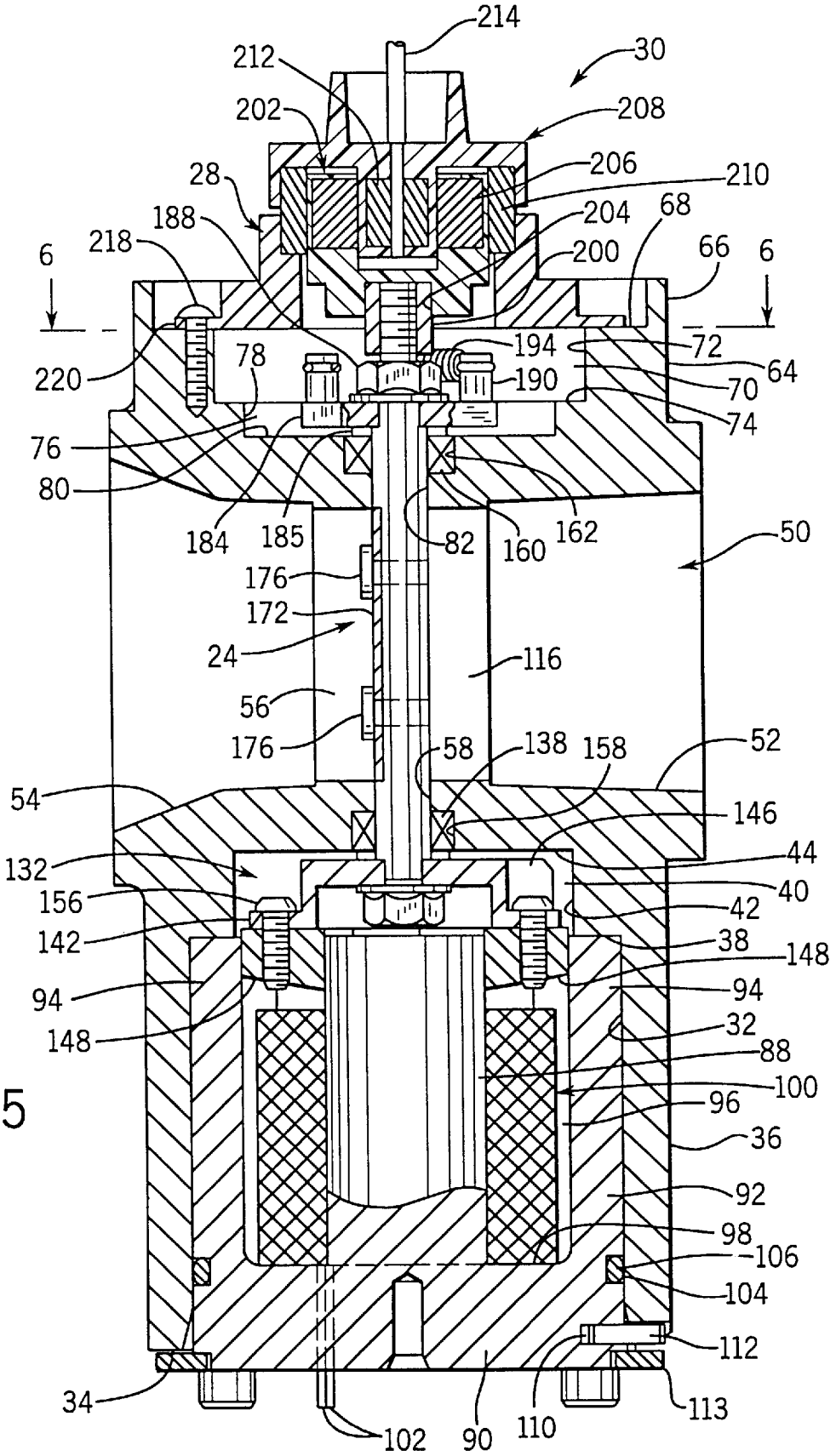
FIG. 5 is a longitudinal sectional view of the throttle valve assembly of the invention, taken along line 5—5 of FIG. 2.

As shown in FIGS. 3 and 5, valve body 18 is a one-piece integrally formed member, preferably cast of a non-ferrous metallic material such as aluminum or any other satisfactory material. Valve body 18 extends along a longitudinal axis, and defines an actuation device cavity 32 extending along the longitudinal axis of valve body 18 and opening onto an end surface, shown at 34, defined by valve body 18. The lateral extent of actuation device cavity 32 is defined by the inside surface of a cylindrical side wall 36 of valve body 18. Actuation device cavity 32 further includes an annular inner shoulder 38 extending perpendicularly to the inside surface of side wall 36, and a recess 40 defined by an annular side surface 42 and an end surface 44. Shoulder 38 extends between the inner surface of side wall 36 and side surface 42.

Valve body 18 further defines a rectangular mounting rim 46 disposed between end surface 34 and side wall 36. A series of threaded passages 48 are formed in mounting rim 46 opening onto end surface 34.

A transverse flow passage 50 is formed in valve body 18. Flow passage 50 includes an inwardly tapered inlet portion 52, an outwardly flared outlet portion 54 and a central portion 56 located between inlet portion 52 and outlet portion 54. Flow passage portions 52–56 are formed by initially forming a rough passage in the casting from which valve body 18 is formed, and then machining the rough passage to attain the final configuration of flow passage 50 as shown. A passage 58 forms an opening establishing communication between actuation device cavity 32 and flow passage 50.

Valve body 18 includes a mounting flange 60 at the end of flow passage 50 onto which inlet portion 52 opens, for engagement with mounting structure associated with engine 12 so as to secure throttle valve 10 and mixer 14 to engine 12. In addition, valve body 18 defines a mounting flange 62 at the end of flow passage 50 onto which outlet passage 54 opens, which is adapted for mounting to mixer 14.

Valve body 18 further includes an end portion 64 on the side of flow passage 50 opposite side wall 36. End portion 64 includes an upstanding peripheral wall 66 surrounding an annular outer shoulder 68. An intermediate recess 70 extends inwardly from outer shoulder 68, and is defined by a side wall 72 in combination with an inner shoulder 74. A stop recess 76 is formed in end portion 64 inwardly of inner shoulder 74 and is defined by a side wall 78 and an outwardly facing end wall 80. A passage 82 extends between stop recess 76 and flow passage 50, forming an opening establishing communication therebetween. Passage 82 is coaxial with passage 58, and both passages 58 and 82 are coaxial with the longitudinal axis of valve body 18 and the longitudinal axes of actuation device cavity 32, stop recess 76 and intermediate recess 70.

With this construction, valve body end portion 64 defines a stepped cavity which opens in a direction opposite that of actuation device cavity 32 and which is coaxial with the longitudinal axis of motor actuation device 32. Valve body 18 thus defines a generally cross-shaped or "t"-shaped configuration with the longitudinal portion being defined by end portion 64 and side wall 36 and the transverse portion being defined by the structure of valve body 18 through which flow passage 50 extends.

As shown in FIGS. 3 and 5, electromagnetic actuation device 20 includes a coil housing 86 which is formed of a ferrous material such as steel or other magnetic material. Coil housing 86 includes a solid central core 88 extending from a solid end section 90. A peripheral annular housing wall 92 extends from end section 90 in the same direction as core 88, and a pair of opposed wings or walls 94 extend from housing wall 92.

Core 88, housing wall 92 and opposed walls 94 cooperate to define a coil recess 96 located between the outwardly facing surface of core 88 and the inwardly facing surfaces of housing wall 92 and opposed walls 94. An end surface 98 extends between core 88 and housing wall 92 defining the inner end of coil recess 96. Coil recess 96 opens onto the end of coil housing 86 opposite end section 90.

A coil assembly 100 is received within coil recess 96. Coil assembly 100 is constructed of a large number of turns of magnet wire in a manner as is known, and may be bonded to coil housing 86 in any satisfactory manner, such as by an epoxy adhesive or the like. Leads 102 extend from coil assembly 100 and through a passage formed in coil housing end section 90, and are connected to a source of electrical power for selectively energizing coil assembly 100, in a manner as is known.

Electromagnetic actuation device 20 is received within actuation device cavity 32 as shown in FIG. 5, in which the ends of opposed walls 94 engage shoulder 38 defining the inner end of actuation device cavity 32. A groove 104 is formed in the outer surface of coil housing 86, and an o-ring 106 is received within groove 104. O-ring 106 bears against the inside surface of valve body side wall 36 for sealing the interior of electromagnetic actuation device 20.

A slot 108 is formed in valve body mounting rim 46, and an aperture 110 is formed in coil housing end section 90, facing outwardly toward the inner surface of side wall 36. Electromagnetic actuation device 20 is received within actuation device cavity 32 and is oriented such that aperture 110 is in alignment with slot 108, and a roll pin 112 extends through slot 108 into engagement with aperture 110 for fixing the rotational position of electromagnetic actuation device 20 relative to valve body 18. After electromagnetic actuation device 20 is positioned within actuation device cavity 32 in this manner, a cover plate 113 is engaged with valve body end surface 34. Cover plate 113 is mounted to valve body 18 via a series of threaded fasteners 114 which extend into threaded passages 48 through aligned openings in cover plate 113. An opening 115 is formed in cover plate 113 for receiving the stepped lower end of coil housing end section 90.

Electromagnetic actuation device 20 is an electromagnetic stator which operates in a manner as is known for electromagnetic actuators, so as to selectively magnetize coil housing 86 when electrical energy is supplied to coil assembly through leads 102. The strength of the magnetic field of coil housing 86 can be varied by varying the supply of electrical energy to coils 100.

Referring to FIGS. 2, 3 and 5, valve shaft assembly 22 includes an axially extending shaft member 116 having a first threaded end 118 and a second threaded end defining an inner threaded portion 120 and an outer threaded portion 122. A first pair of flats 124 are formed on the end of shaft member 116 adjacent threaded end 118, and a second pair of flats 126 are formed on the end of shaft member 116 adjacent inner threaded portion 120, opposite the first pair of flats 124. A flat mounting area 128 is formed on a side of shaft member 116, and a pair of threaded passages 130 extend inwardly from flat mounting area 128.

A pole carrier 132 is engaged with one end of shaft member 116. Pole carrier 132 includes a central opening 134 having a configuration which matches that of the end of shaft member 116 defined by flats 124. In this manner, pole carrier 132 is mounted to the end of shaft member 116 by inserting threaded end 118 through opening 134 such that the central part of pole carrier 134 is seated against flats 124 and the shoulder defined by flats 124. A lock nut 136 having an integral washer is threaded onto threaded end 118 so as to mount pole carrier 132 to shaft member 116.

Prior to mounting pole carrier 132 to shaft member 116 as described, a bearing assembly 138 is mounted onto shaft member 116 and is located inwardly of flats 124. A nylon washer 140 is interposed between bearing assembly 138 and the facing surface of pole carrier 132.

Pole carrier 132 includes a peripheral outer flange 142 located outwardly of the central portion of pole carrier 132 within which opening 134 is formed. Opposed pairs of passages 144 extend through flange 142. A series of ribs 146 are formed on pole carrier 132 for strengthening flange 142, and the voids between ribs 146 function to reduce to the overall weight of pole carrier 132.

In a preferred form, the components of valve shaft assembly 22 described above are formed of an non-ferrous metallic material, such as aluminum.

A pair of pole members 148 are mounted to mounting flange 142 of pole carrier 132. Each pole member 148 has a generally arcuate shape, including a head section 150 and a tapered tail section 152. Spaced passages 154 are formed in each tail section 152, and are adapted to be placed into alignment with one of the pair of passages 144 formed in pole carrier flange 142. Passages 154 are threaded, and threaded fasteners 156 extend through passages 144 in flange 142 and into engagement with threaded passages 154, for mounting pole members 148 to flange 142. In a manner as is known, pole members 148 are formed of a ferrous material such as steel, or other material having magnetic properties.

Figure 4:
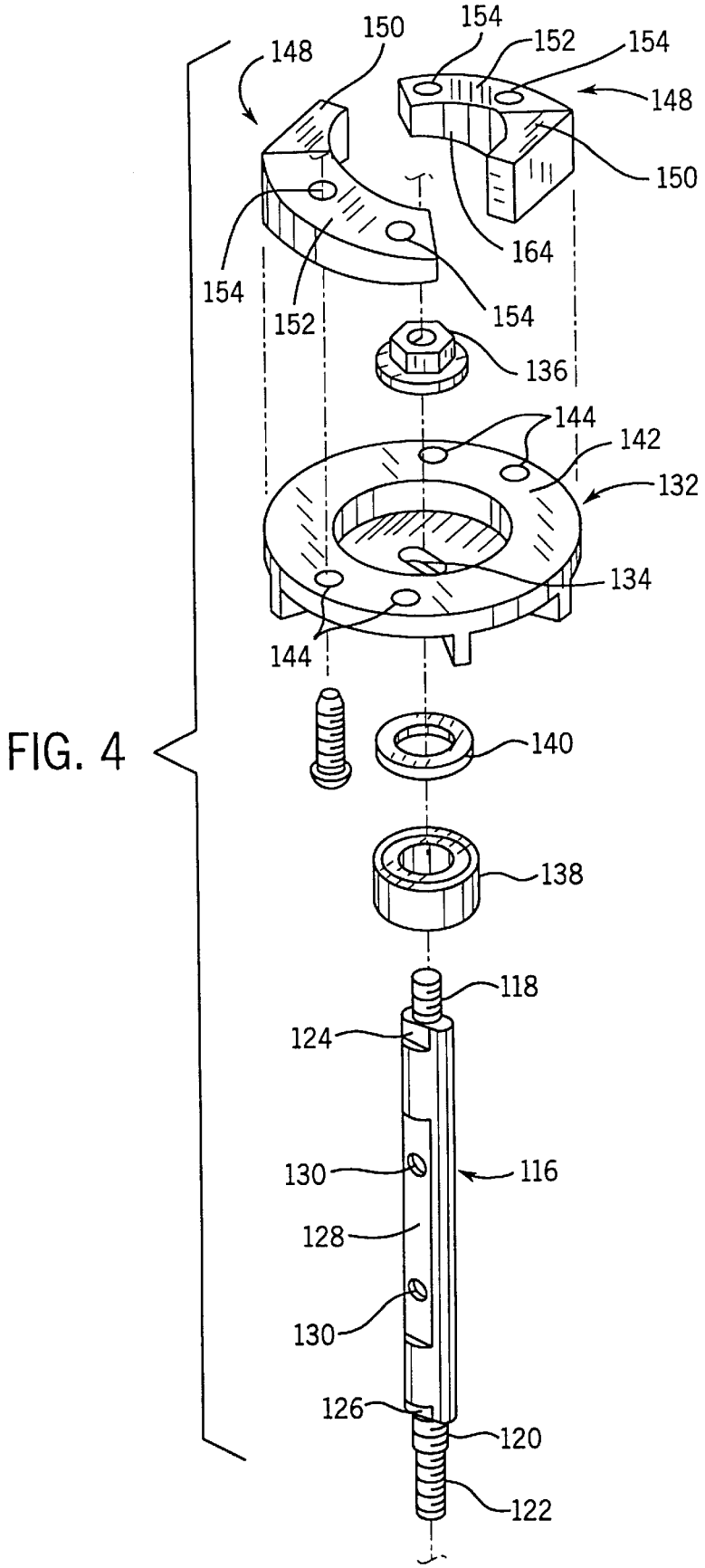
FIG. 4 is an exploded isometric view of a valve assembly incorporated into the throttle valve assembly of FIG. 2 and as illustrated in assembled condition in FIG. 3.

In assembly, valve shaft assembly 22 is first constructed as shown in FIGS. 3 and 4, such that bearing assembly 138 and pole carrier 132 are mounted to shaft member 116 and pole members 148 are mounted to pole carrier 142. Shaft assembly 22 is then assembled to valve body 18 by passing the end of shaft member 116 opposite pole carrier 132 through actuation device cavity 32 and passing shaft member 116 through passage 58, and then through flow passage 50 and through passage 82 such that the end of shaft member 116 opposite pole carrier 132 extends into stop recess 76 and intermediate recess 70 formed in valve body end portion 64. A bearing recess 158 extends inwardly from recess end surface 44 for receiving bearing assembly 138. Once shaft assembly 22 is positioned relative to valve body 18 in this manner, a bearing assembly 160 is mounted onto the end of shaft member 116 opposite pole carrier 132, and is received within a bearing recess 162 extending inwardly from stop recess end wall 80. Shaft member 116 and pole carrier 132 are thus rotatably mounted to valve body 18 for movement about an axis of rotation coincident with the longitudinal axis of shaft member 116 and the longitudinal axis of valve body 18.

Electromagnetic actuator device 20 is then mounted within actuation device cavity 32 as described previously, to place electromagnetic actuator device 20 in the position as shown in FIG. 5 relative to shaft member 116, pole carrier 132 and pole members 148.

As shown in FIG. 5, pole members 148 are received within the upper portion of coil recess 96 between coil housing opposed walls 94 and core 100, above the end of coil assembly 100. The facing inner surfaces of pole members 148, shown at 164, are provided with a radius slightly larger than that of the outer surface of core 88, such that pole members 148 essentially wrap around core 88. Pole carrier 132 and pole members 148 are configured such that pole members 148 do not contact core 88, to provide frictionless rotation of pole carrier 132.

With the construction and arrangement of pole members 148 relative to coil 100 and coil housing 86, the selective energization of coil assembly 100 functions to supply flux to coil housing 86 and pole members 148, to selectively attract or repel pole members 148 relative to coil housing 86, in a manner as is known. It has been found that the arrangement of pole members 148, coil housing opposed walls 94 and core 88, including the solid construction of core 88, provides a highly accurate and reliable mechanism for moving shaft 116 to a desired rotational position through pole carrier 132 without friction.

In the past, a passage was formed in the coil housing core in order to accommodate a shaft having a carrier to which the pole members were mounted. With the construction of the present invention, the passage in the coil housing core is eliminated so as to increase the available mass of material for magnetic flux upon energization of the coil, i.e. housing 86 provides a greater volume of magnetic material for carrying the magnetic flux to increase the magnetization experienced by pole members 148. The present invention thus significantly enhances motor operation and increases torque by eliminating the passage in the core.

After shaft assembly 22 has been assembled to valve body 18 in the manner as shown and described, valve member 24 is assembled to shaft member 116. Referring to FIG. 3, valve member 24 defines a pair of wings 168 which extend in opposite directions from a central offset mounting area 170. Mounting area 170 includes a flat end wall 172 and a pair of side walls, each of which extends between end wall 172 and one of wings 168. A pair of openings 174 are formed in end wall 172. In a preferred form, valve member 124 is a stamped member formed to define mounting area 170 and the side walls located between each wing 168 and mounting area 170. This provides a relatively low cost of manufacture for valve member 24.

Valve member 24 is assembled to shaft member 116 by engaging mounting area 170 of valve member 24 with flat mounting area 128 of shaft member 116, such that openings 174 are in alignment with threaded passages 130 in shaft member 116. Threaded fasteners 176 are then inserted through openings 174 and into threaded engagement with threaded passages 130, for securing valve member 24 in position on shaft member 116. The length of valve member mounting area 170 substantially corresponds to the length of flat mounting area 128 as shown in FIG. 5, and the side walls of mounting area 170 wrap around shaft member 116 adjacent flat mounting area 128. This construction functions to positively locate and engage valve member 24 with shaft member 116 and to provide strength and a low cost of manufacture and assembly for both shaft member 116 and valve member 24.

FIGS. 3 and 5–7 illustrate stop arrangement 26 and its interrelationship with valve shaft assembly 22 and valve body 18.

Figure 6:
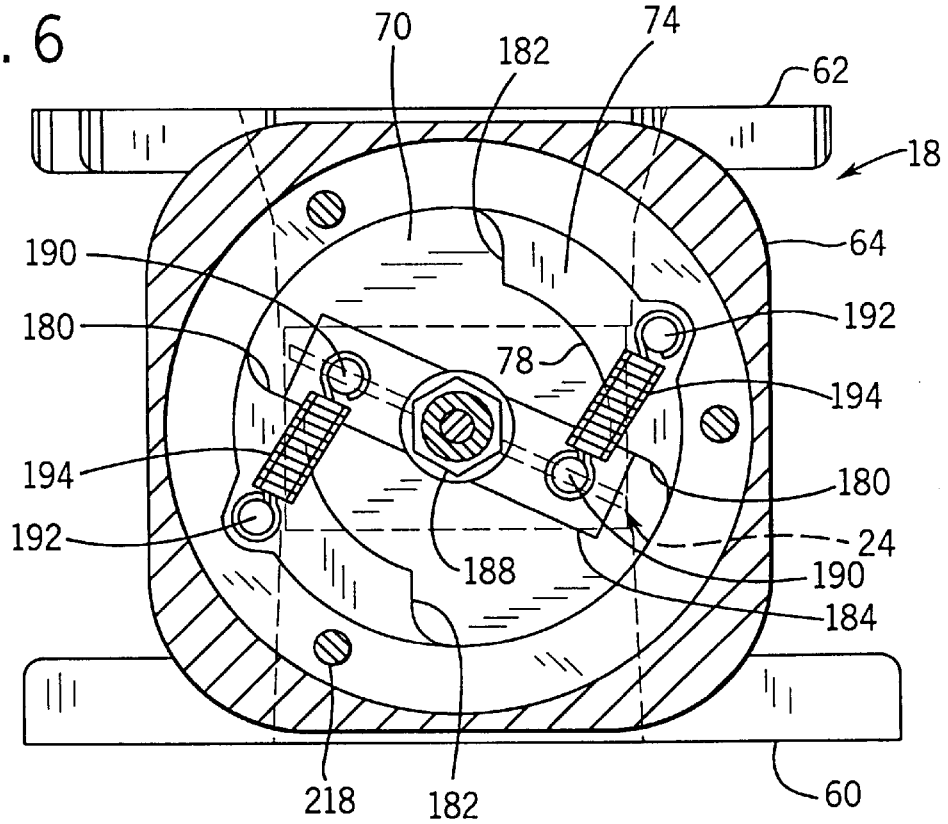
FIG. 6 is a section view taken along line 6—6 of FIG. 5, showing the stop arrangement in a first position in which the valve member is closed to cut off the supply of air or fuel-air mixture through the flow passage.
Figure 7:
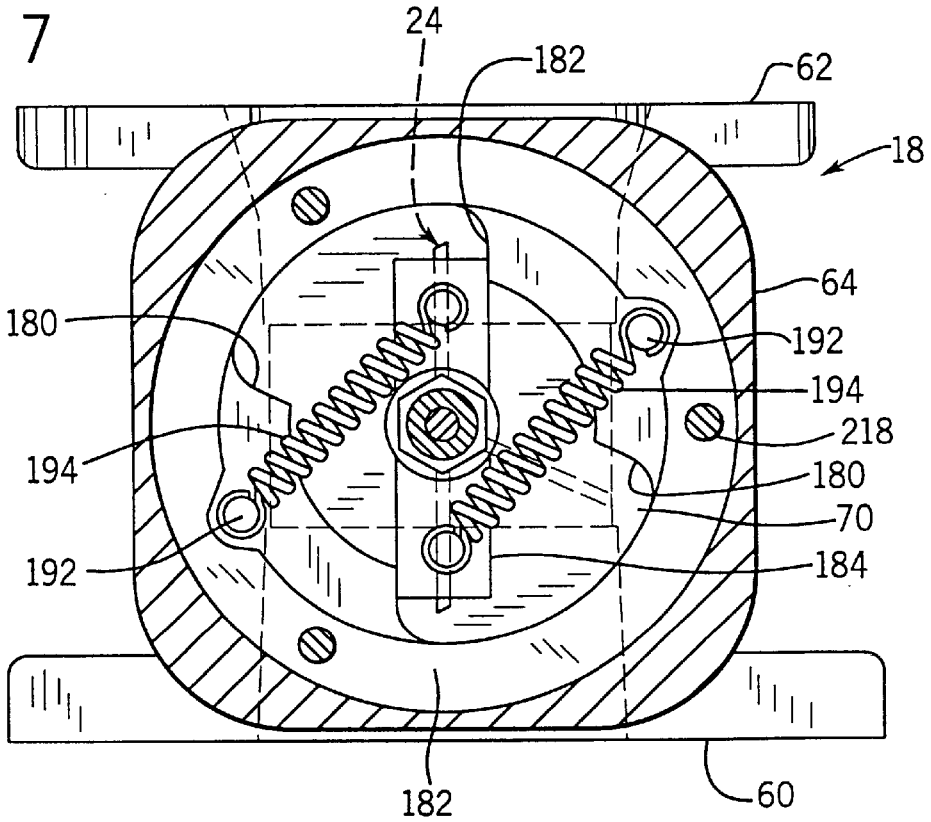
FIG. 7 is a view similar to FIG. 6, showing the stop arrangement positioned to place the valve member in a fully opened position.

Referring to FIGS. 6 and 7, stop recess side wall 78 defines a first pair of stop surfaces 180 and a second pair of stop surfaces 182. When shaft member 116 is assembled to valve body 18 as described above and as illustrated, the end of shaft member 116 adjacent inner threaded portion 120 is disposed within stop recess 76. A stop plate 184 is engaged with this end of shaft member 116, and is supported by a nylon washer 185 (FIGS. 3, 5) located between bearing assembly 160 and stop plate 184. As shown in FIG. 3, stop plate 184 includes an opening 186 having a configuration which matches that of shaft member 116 including flats 124. A lock nut 188 including an integral washer is engaged with inner threaded portion 120. In this manner, stop plate 184 is mounted to shaft member 116 and is retained in position within stop recess 76.

A spring post 190 is press-fit into an opening located adjacent each end of stop plate 184. In a similar manner, a pair of spring posts 192 are press-fit into openings formed in inner shoulder 74 of valve body 18. A return spring 194 is interconnected at one end with one of spring posts 190 and at its other end with the adjacent spring post 192. In this manner, springs 194 function to bias stop plate 184 in a counterclockwise direction, with reference to FIGS. 6 and 7, so as to bias valve member 24 toward a closed position in which valve member 24 substantially cuts off the flow of air or fuel-air mixture through flow passage 50. In operation, energization of electromagnetic actuation device 20 functions to impart rotation to shaft member 116 through pole members 148 and pole carrier 132, so as to move valve member 24 away from its closed position against the force of springs 194. In a manner as is known, increasing the amount of electrical energy supplied to coil assembly 100 increases the torque or rotational force exerted on pole members 148, to further move valve member 24 away from its closed position against the force of springs 194, which supply return torque.

When the supply of electrical energy to coil assembly 100 is cut off, return springs 194 move stop plate 184 into engagement with stop surfaces 180 so as to place valve member 24 in its fully closed position. As the energization of coil assembly 100 increases, shaft member 116 is rotated in a clockwise direction to move valve member 24 towards its open position against the force of return springs 194, until engagement of stop plate 184 with stop surfaces 182. In this manner, electromagnetic actuation device 20 is operable to control the position of valve member 24 between a fully closed position and a fully opened position against the force of return springs 194, with the range of movement of valve member 24 being determined by engagement of stop plate 184 with stop surfaces 180 and 182. The integral formation of stop surfaces 180 and 182 with valve body 18 provides a compact and efficient arrangement for controlling the range of movement of shaft member 116.

Referring to FIGS. 3 and 5, a sensor assembly 30 is mounted to valve body end portion 64 via mounting flange 28. Sensor assembly 30 may be as shown and described in copending application Ser. No. 08/967,167 filed Nov. 10, 1997 entitled "Angular Position Sensor Using a Hall-Effect Transducer", (V. Pecheny, G. Anderson), the disclosure of which is hereby incorporated by reference. Generally, sensor assembly 30 functions to detect the relative position of shaft member 116 relative to valve body 18, which in turn detects the position of valve member 24 within flow passage 50. In a manner to be explained, sensor assembly 30 functions without contact between parts to provide a frictionless wear-free assembly for detecting the position of shaft member 116.

Sensor assembly 30 includes an adapter bushing 200 engaged with outer threaded portion 122 of shaft member 116. A molded permanent magnet carrier 202 defines a passage 204 into which adapter bushing 200 is molded, so as to mount magnet carrier 202 to shaft member 116 through adapter bushing 200. An annular permanent magnet member 206 is insert molded into magnet carrier 202. Magnet member 206 may illustratively be a Plastiform® brand molded alnico diametrically magnetized permanent magnet. With this construction, rotation of shaft member 116 under the influence of electromagnetic actuation device 20 results in rotation of magnet member 206.

Sensor assembly 30 further includes a molded non-magnetic sensor housing 208 having a magnetic material sleeve insert 210 and a magnetic material cylindrical segment insert 212 insert molded therewith.

A series of Hall-effect transducer leads, such as shown at 214, are connected to a sensor cable (not shown) for providing signals to controller 16 indicative of the position of shaft member 116 and valve member 24 by providing Hall-effect outputs from the magnetic interaction between cylindrical segment insert 212, permanent magnet member 206, and sleeve 210. With this arrangement, sensor assembly 198 provides a continuous input to controller 16 as to the position of valve member 24, and controller 16 processes such signals and is operable to control the supply of electrical energy to electromagnetic actuation device 20 to vary the position of valve member 24 according to operating inputs provided to controller 16.

Sleeve insert 210 is engaged with mounting flange 28, which in turn is secured to valve body end portion 64 by a series of fasteners such as 218 extending through openings formed in mounting flange 28 and into threaded engagement with threaded passages formed in outer shoulder 68. In this manner, the stationary portion of sensor assembly 30 is mounted to the open end of valve body end portion 64.

It can thus be appreciated that the invention provides a compact and efficient arrangement for the components of throttle valve 10 and its method of assembly. The entire valve body 18 is a one-piece member which simply requires mounting of valve shaft assembly 22 to valve body 18, and then assembly of stop arrangement 26, sensor assembly 30, and electromagnetic actuation device 20. This eliminates the need for separate housings for the various components of a throttle valve as in the prior art, and provides simplicity in construction and reduction in the overall number of parts and time required to produce throttle valve 10. As can be appreciated, only bearings 138, 160 and springs 194 contact valve shaft assembly 22, which provides very low friction and thus accurate positioning of valve shaft assembly 22. The main components within electromagnetic actuation device 20 and sensor assembly 30 rotate without contact, thus increasing life expectancy by reducing wear.

While the primary application of the invention is to throttle a fuel-air mixture to an engine or throttle air to a fuel injected engine, this arrangement could also be applied to throttle compressed natural gas as part of an electronically actuated mixture control or any other application where continuously variable, electronically controlled throttling of a gaseous fluid is required.

Various alternatives and embodiments are contemplated as being within the scope of the following claims particularly pointing out and distinctly claiming the subject matter regarded as the invention.

We claim:

1. A throttle valve assembly for supplying air or fuel-air mixture to an intake associated with an engine, comprising:

an integrally formed valve body adapted for mounting to the engine, wherein the valve body defines an actuation device cavity, a flow passage adapted to communicate with the engine intake, a sensor mounting structure, a first opening communicating between the flow passage and the actuation device cavity, and a second opening communicating between the flow passage and a location adjacent the sensor mounting structure;

a valve shaft extending transversely through the flow passage and including a first portion extending through the first opening and a second portion extending through the second opening, wherein the valve shaft is rotatably supported within the first and second openings relative to the valve body;

a valve member mounted to the valve shaft and disposed within the flow passage, wherein the valve member comprises of pair of wings extending laterally from an axially extending offset central mounting portion adapted to be secured to the valve shaft;

a pole carrier interconnected with the valve shaft;

a pole arrangement interconnected with the pole carrier;

an electromagnetic actuation device received within the actuation device cavity, comprising a coil housing including a substantially solid central core and defining an annular coil recess surrounding the core and opening onto an end defined by the coil housing, an outer wall located outwardly of the coil recess, and a coil received within the coil recess, wherein the pole arrangement extends into the coil recess without contacting the coil housing for selectively imparting rotation to the pole carrier, and thereby to the valve shaft, in response to energization of the coil;

a position indicating member interconnected with the second portion of the valve shaft;

a position sensing arrangement mounted to the sensor mounting structure defined by the valve body for sensing the position of the shaft, and thereby the valve member, in response to orientation of the position indicating member relative to the position sensing arrangement;

wherein the sensor mounting structure and the actuation device cavity are located on opposite ends of the valve body and wherein the flow passage is located between the sensor mounting structure and the actuation device cavity;

stop structure defined by the valve body adjacent the sensor mounting structure and including a shoulder; and a stop member interconnected with the valve shaft and oriented relative to the valve body so as to engage the shoulder when valve shaft attains a predetermined position relative to the valve body and the flow passage for preventing further movement of the valve member relative to the valve body, wherein the position sensing arrangement is interconnected with the valve body via a flange member secured to the valve body, wherein the flange member is constructed and arranged to enclose the stop structure and to mount the position sensing arrangement to the valve body.

2. A throttle valve assembly for supplying air or fuel-air mixture to an intake associated with an engine, comprising:

an integral valve body including a flow passage adapted for communication with the engine intake, an actuation device cavity, a sensor mounting structure, a first opening communicating between the flow passage and the actuation device cavity, and a second opening communicating between the flow passage and a location adjacent the sensor mounting structure;

an actuation device mounted within the actuation device cavity;

a shaft member extending transversely through the flow passage and having a first portion extending through the first opening and a second portion extending through the second opening, wherein the shaft member is rotatably supported relative to the valve body;

a valve member mounted to the shaft member and disposed within the flow passage;

a coupling interconnected with a first end of the shaft member for imparting rotation to the shaft member in response to operation of the actuation device;

a position indicating member interconnected with the second portion of the shaft member; and a position sensing arrangement mounted to the sensor mounting structure defined by the valve body for sensing the position of the shaft member, and thereby the valve member, in response to orientation of the position indicating member relative to the position sensing arrangement.

3. The throttle valve assembly of claim 2, wherein the shaft member comprises an axially extending valve shaft, and wherein the first and second openings are in alignment with each other.

4. The throttle valve assembly of claim 3, wherein the actuation device includes an inner end defining an annular recess, and wherein the first portion of the valve shaft terminates in an end spaced from the inner end of the actuation device.

5. The throttle valve assembly of claim 4, wherein the valve body further defines a recess located between the actuation device cavity and the flow passage, wherein the actuation device comprises an electromagnetic actuation arrangement, and further comprising a pole carrier mounted to the first portion of the valve shaft and located within the recess defined by the valve body, and wherein one or more pole members are mounted to the pole carrier and received within the annular recess defined by the actuation device.

6. The throttle valve assembly of claim 1, wherein the valve member comprises a pair of wings extending laterally from an axially extending offset central mounting portion adapted to be secured to the valve shaft within the flow passage.

7. The throttle valve assembly of claim 3, wherein a stop arrangement is interconnected with the second portion of the valve shaft for preventing movement of the valve arrangement relative to the valve body when the valve arrangement attains a predetermined position relative to the valve body.

8. The throttle valve assembly of claim 7, wherein the stop arrangement comprises stop structure defined by the valve body and including a shoulder, and a stop member mounted to the second portion of the valve shaft and oriented relative to the valve body so as to engage the shoulder when the valve arrangement attains a predetermined position relative to the valve body and the flow passage.

9. The throttle valve assembly of claim 8, further comprising one or more biasing members interconnected between the valve body and the stop member for biasing the valve shaft in a predetermined direction relative to the valve body.

10. The throttle valve assembly of claim 8, wherein the valve body defines a recess adjacent the sensor mounting structure within the stop member is received, and wherein the shoulder is located within the recess, and wherein the position sensing arrangement is mounted to the valve shaft outwardly of the recess and the stop member.

11. A throttle valve assembly for supplying air or fuel-air mixture to an intake associated with an engine, comprising:

a one-piece valve body defining opposed first and second ends and a transverse flow passage intermediate the first and second ends, wherein the valve body includes an actuation device cavity opening onto the first end;

an actuation device received within the actuation device cavity;

a valve arrangement rotatably mounted to the valve body and including a valve member disposed within the flow passage;

a contactless drive coupling interposed between the actuation device and the valve arrangement for imparting rotating movement to the valve arrangement in response to operation of the actuation device; and a sensor arrangement interconnected with the second end of the valve body for interfacing with the valve assembly and sensing the position of the valve member relative to the valve body.

12. The throttle valve assembly of claim 11, wherein the actuation device comprises a coil-type electromagnetic actuation device defining an inner end within which an annular recess is formed, and wherein the contactless drive coupling comprises one or more pole members interconnected with the valve arrangement and received within the annular recess.

13. The throttle valve assembly of claim 12, wherein the valve arrangement comprises a valve shaft rotatably mounted to the valve body, and wherein a pole carrier is mounted to the valve shaft and the one or more pole members are carried by the pole carrier.

14. The throttle valve assembly of claim 13, wherein the valve body includes a recess located between the flow passage and the actuation device cavity, wherein the pole carrier is located within the recess.

15. The throttle valve assembly of claim 14, wherein the valve shaft defines an end spaced inwardly from the inner end of the electromagnetic actuation device, and wherein the pole carrier is mounted to the end of the valve shaft.

16. The throttle valve assembly of claim 11, wherein the sensor arrangement comprises a sensor mounting member secured to the valve body, and a sensor mounted to the sensor mounting member for sensing the position of the shaft relative to the valve body.

17. The throttle valve assembly of claim 16, wherein the sensor mounting member is mounted over a recess formed in the second end of the valve body, wherein the recess faces in a direction opposite the first end of the valve body onto which the actuation device cavity opens.

18. The throttle valve assembly of claim 16, wherein the sensor mounting member is mounted over a recess formed in the second end of the valve body, and further comprising a stop member interconnected with the valve member and located within the recess, wherein the valve body defines a shoulder with which the stop member is engageable for preventing movement of the valve arrangement relative to the valve body when the valve arrangement attains a predetermined position relative to the valve body.

19. An electromagnetic actuation device for imparting rotation to an output member, comprising:

a coil housing including a substantially solid central core, an annular coil recess surrounding the core and opening onto an end defined by the coil housing, and an outer wall located outwardly of the coil recess;

a coil received within the coil recess;

a pole carrier interconnected with the output member; and a pole arrangement mounted to the pole carrier, wherein the pole arrangement is oriented relative to the coil housing such that the pole arrangement extends into the coil recess inwardly of the end defined by the coil housing without contacting the coil housing.

20. The electromagnetic actuation device of claim 19, wherein the pole carrier is located outwardly of the end defined by the coil housing.

21. The electromagnetic actuation device of claim 20, wherein the pole carrier defines a central portion and a peripheral flange located outwardly of the central portion, wherein the pole arrangement is mounted to the outer flange of the pole carrier.

22. The electromagnetic actuation device of claim 19, wherein the coil defines a surface spaced from the end defined by the coil housing, and wherein the pole arrangement extends into the coil recess and is spaced from the surface defined by the coil.

23. The electromagnetic actuation device of claim 22, wherein the pole carrier is located outwardly of the end defined by the coil housing.

24. The electromagnetic actuation device of claim 19, further comprising a shaft to which the pole carrier is mounted, wherein the shaft extends through a passage defined by a valve body and wherein a valve member is mounted to the shaft, wherein the electromagnetic actuation device is operable to selectively impart rotation to the shaft through the pole arrangement and the pole carrier to position the valve member within the passage.

25. A drive arrangement for a throttle valve assembly including a valve body defining a flow passage and a valve arrangement disposed within the flow passage, comprising:

an actuation device cavity formed in the valve body;

a coil-type electromagnetic actuation device received within the actuation device cavity and interconnected with the valve body, wherein the electromagntic actuation device includes a coil housing defining an annular coil recess;

a recess formed in the valve body and extending from an inner end defined by the actuation device cavity;

an output member interconnected with the valve arrangement and rotatably mounted to the valve body;

a pole carrier disposed within the recess and interconnected with the output member; and a pole arrangement interconnected with the pole carrier and extending into the coil recess without contacting the coil housing for selectively imparting rotation to the pole carrier, and thereby to the output member, in response to energization of the coil-type electromagnetic actuation device.

26. A stop arrangement for a throttle valve assembly including a valve body defining a flow passage and a valve arrangement movably mounted to the valve body and disposed within the flow passage, comprising;

stop structure defined by the valve body and including a shoulder; and a stop member interconnected with the valve arrangement and oriented relative to the valve body so as to engage the shoulder when the valve arrangement attains a predetermined position relative to the valve body and the flow passage for preventing further movement of the valve arrangement relative to the valve body when the valve arrangement attains a predetermined position relative to the valve body.

27. The stop arrangement of claim 26, wherein the stop member is located within a recess defined by the valve body, and wherein the shoulder is located within the recess.

28. The stop arrangement of claim 27, wherein the valve arrangement includes a valve shaft to which the stop member is mounted, wherein the valve shaft extends into the recess.

29. The stop arrangement of claim 27, further comprising one or more biasing members interconnected between the valve body and the stop member for biasing the valve arrangement toward a predetermined position relative to the valve body.

30. The stop arrangement of claim 29, wherein the one or more biasing members comprises one or more springs, wherein each spring is engaged at a first end with a post mounted to the stop member and at a second end with a post interconnected with the valve body.

31. The stop arrangement of claim 26, wherein the valve arrangement includes a valve shaft to which the stop member is mounted, and further comprising a position sensing arrangement interconnected with the valve shaft adjacent the stop member for detecting the position of the valve arrangement relative to the valve body.

32. A position sensing arrangement for a throttle valve assembly, comprising:

a valve body defining opposed first and second ends and a transverse flow passage intermediate the first and second ends, wherein the first end of the valve body includes a drive arrangement cavity and the second end of the valve body includes sensor mounting structure;

a valve arrangement rotatably mounted to the valve body for movement about an axis of rotation and disposed within the flow passage;

a drive arrangement located within the drive arrangement cavity for selectively imparting rotation to the valve arrangement to alter the position of the valve arrangement relative to the valve body;

an extension member interconnected with the valve arrangement, a position indicating member carried by the extension member; and a position sensing arrangement secured to the sensor mounting structure of the valve body for sensing the position of the valve arrangement without contacting the position indicating member, in response to orientation of the position indicating member relative to the position sensing arrangement.

33. The position sensing arrangement of claim 32, wherein the valve arrangement comprises a valve shaft to which the extension member is mounted.

34. The position sensing arrangement of claim 33, further comprising a sensor mounting member engaged with the sensor mounting structure of the valve body for mounting the position sensing arrangement to the valve body.

35. The position sensing arrangement of claim 34, wherein the sensor mounting member is located over a recess defined by the valve body, and wherein the extension member extends through the recess.

36. The position sensing arrangement of claim 33, wherein the valve shaft defines an end and wherein the extension member comprises an adapter bushing engaged with the end of the valve shaft.

37. The position sensing arrangement of claim 36, wherein the position indicating member comprises a magnetic member interconnected with the adapter bushing and wherein the position sensing arrangement interfaces with the magnetic member so as to detect the position of the valve shaft relative to the valve body.

38. A throttle valve assembly, comprising:

a valve body defining a flow passage and a recess;

a valve arrangement including a valve member carried by a shaft rotatably mounted to the valve body;

an actuation device drivingly interconnected with the valve arrangement for controlling the position of the valve member relative to the valve body;

a stop member interconnected with the shaft;

stop structure including a shoulder defined by the valve body recess, wherein engagement of the stop member with the shoulder is operable to position the shaft in a predetermined position relative to the valve body and to place the valve member in a predetermined position within the flow passage;

a position indicating member carried by the shaft;

a position sensing arrangement for sensing the position of the valve arrangement relative to the valve body according to the orientation of the position indicating member; and a cover member interconnected with the position sensing arrangement and secured to the valve body over the recess for enclosing the stop structure and for mounting the position sensing arrangement to the valve body.

39. A valve arrangement for a throttle valve including a valve body defining a flow passage, comprising:

a valve shaft adapted for rotatable mounting to the valve body;

a drive arrangement interconnected with the valve shaft for selectively imparting rotation to the valve shaft; and a valve member for placement within the flow passage, wherein the valve member comprises a pair of wings extending laterally from an axially extending offset central mounting portion adapted to be secured to the valve shaft.

40. The valve arrangement of claim 39, wherein the valve shaft extends through a pair of openings formed in the valve body and opening into the flow passage.

41. The valve arrangement of claim 39, wherein the valve shaft includes a substantially flat mounting area with which the offset central mounting portion of the valve member is engaged.

42. The valve arrangement of claim 41, wherein one or more threaded passages extend inwardly from the substantially flat mounting area, and further comprising a threaded connector adapted to extend through an opening formed in the central mounting portion of the valve member and into engagement with each threaded passage for securing the valve member to the valve shaft.

43. The valve arrangement of claim 39, wherein the pair of wings are formed integrally with the offset central mounting portion.

44. A method of making a throttle valve, comprising the steps of:

providing a one-piece valve body defining opposed first and second ends and including a transverse flow passage intermediate the first and second ends wherein the first end defines an actuation device cavity and wherein the second end defines sensor mounting structure wherein the body further includes a first opening extending between the actuation device cavity and the flow passage, and a second opening on an opposite side of the flow passage from the first opening;

inserting a valve shaft into the flow passage such that a first portion of the valve shaft is rotatably received within the first opening and a second portion of the valve shaft is rotatably received within the second opening;

securing a valve member to the valve shaft within the flow passage;

mounting an actuation device within the actuation device cavity;

drivingly coupling the actuation device with the first portion of the valve shaft, wherein operation of the actuation device functions to control the position of the valve member within the flow passage; and mounting a position sensing arrangement to the sensor mounting structure, wherein the position sensing arrangement interacts with the second portion of the valve shaft to sense the position of the valve member relative to the valve body.

45. A throttle valve assembly for supplying air or fuel-air mixture to an intake associated with an engine, comprising:

a valve body defining a flow passage, an actuation device cavity, and a recess located between the flow passage and the actuation device cavity;

a valve shaft rotatably mounted to the valve body;

a valve member carried by the valve shaft and disposed within the flow passage;

an electromagnetic drive actuation device mounted to the valve body, wherein the electromagnetic drive actuation device defines an inner end within which an annular recess is formed, and wherein the valve shaft defines an end spaced from the inner end of the actuation device;

a pole carrier interconnected with the end of the valve shaft and disposed within the recess; and a pole arrangement carried by the pole carrier, wherein the pole arrangement extends into the annular recess in the inner end of the actuation device and is drivingly coupled to the electromagnetic actuation device in a contactless manner, wherein operation of the electromagnetic actuation device functions to impart rotation to the valve shaft through the pole arrangement and the pole carrier for controlling the position of the valve member within the flow passage.

* * * * *

UNITED STATES PATENT AND TRADEMARK OFFICE

CERTIFICATE OF CORRECTION

PATENT NO. : 6,116,215
DATED : September 12, 2000
INVENTOR(S) : PAVEL A. SOLEANICOV It is certified that error appears in the above-identified patent and that said Letters Patent is hereby corrected as shown below:

ON THE FACE

[56] Please Add:

-- Other References:

Brochure entitled DYNA "Power Flow 38", by Barber-Colman Company, October 1995

"Lexus With Attitude" AI, September 1997, pages 96-97

"Reader's Choice Top Products, Fuel Injection Integrated With Electronic Governing", SAE Off-Highway Engineering, October 1998, pages 62-63

"Integrated Gaseous Fuel Engine Actuator With Throttle Body", Diesel Progress Engines & Drives, page 68, 1994

"Flo-Tech 60 & 68 Actuator/Driver PS #04140", page 70 --

UNITED STATES PATENT AND TRADEMARK OFFICE

CERTIFICATE OF CORRECTION

PATENT NO. : 6,116,215
DATED : September 12, 2000
INVENTOR(S) : PAVEL A. SOLEANICOV It is certified that error appears in the above-identified patent and that said Letters Patent is hereby corrected as shown below:

IN THE CLAIMS

CLAIM 6, column 12, line 25, delete "1" and substitute therefor -- 2 --; CLAIM 25, column 14, line 20, delete "electromagntic" and substitute therefor -- electromagnetic --; CLAIM 44, column 16, line 37, after "ends" insert -- , --; CLAIM 44, column 6, line 39, after "structure" insert -- , --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*